US007156023B2

(12) United States Patent
Aebi et al.

(10) Patent No.: US 7,156,023 B2
(45) Date of Patent: Jan. 2, 2007

(54) METHOD FOR INSTALLING AN IGNITION SYSTEM, AND IGNITION SYSTEM

(75) Inventors: Walter Aebi, Kyburg-Buchegg (CH); Jan Petzold, Rösrath (DE); Heinz Schäfer, Lilienthal (DE); Andreas Zemla, Troisdorf (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 26 days.

(21) Appl. No.: 10/275,314

(22) PCT Filed: Apr. 18, 2001 (Under 37 CFR 1.47)

(86) PCT No.: PCT/EP01/04376

§ 371 (c)(1), (2), (4) Date: Oct. 28, 2003

(87) PCT Pub. No.: WO01/86323

PCT Pub. Date: Nov. 15, 2001

(65) Prior Publication Data

US 2004/0225431 A1 Nov. 11, 2004

(30) Foreign Application Priority Data

May 5, 2000 (DE) ..... 100 21 683
Jul. 1, 2000 (DE) ..... 100 32 139

(51) Int. Cl.
*F42B 3/26* (2006.01)
*F42C 17/04* (2006.01)

(52) U.S. Cl. ..... 102/312; 102/217

(58) Field of Classification Search ..... 102/311, 102/312, 217

See application file for complete search history.

(56) References Cited

U.S. PATENT DOCUMENTS 5,894,103 A * 4/1999 Shann ..... 102/215
6,644,202 B1 * 11/2003 Duniam et al. ..... 102/312

FOREIGN PATENT DOCUMENTS

| | | |
|---|---|---|
| EP | 0 601 831 A1 * | 6/1994 |
| EP | 0818690 | 1/1998 |
| WO | 00/09967 | 2/2000 |

OTHER PUBLICATIONS

English translation of the International preliminary examination report with Form PCT/IB/338., 7 pages.

* cited by examiner

*Primary Examiner*—Stephen M. Johnson
(74) *Attorney, Agent, or Firm*—Antonelli, Terry, Stout and Kraus, LLP.

(57) ABSTRACT

When an ignition system is installed, the spatial position of an ignition device (5*a* to 5*g*) in relation to the surrounding, its geographical position, is as yet not determined. The user is required to exercise extreme caution in order to ensure that the ignition devices (5*a* to 5*g*) connect to the ignition system (1) in accordance with a predetermined blasting plan. A specially trained person must therefore systematically carry out the sequential connection (compulsory sequence) of each ignition device (5*a* to 5*g*) to the bus line (3) of the ignition system. i.e. logging. The person connecting the ignition devices must execute the ignition of device programming operation in all kinds of conditions, in open country, with utmost caution. This represents a considerable time delay for a blast. If one ignition device is overlooked during logging, the already entered data have to be reprogrammed, which costs time. The invention provides that the geographical position (4*a* to 4*e*, 4*f*', 4*e*) of an ignition device (5*a* to 5*g*) is determined using a satellite-assisted navigation system (GPS) (10) and this position is conveyed to the logger (2).

11 Claims, 4 Drawing Sheets

METHOD FOR INSTALLING AN IGNITION SYSTEM, AND IGNITION SYSTEM

BACKGROUND OF THE INVENTION

Figure 1:
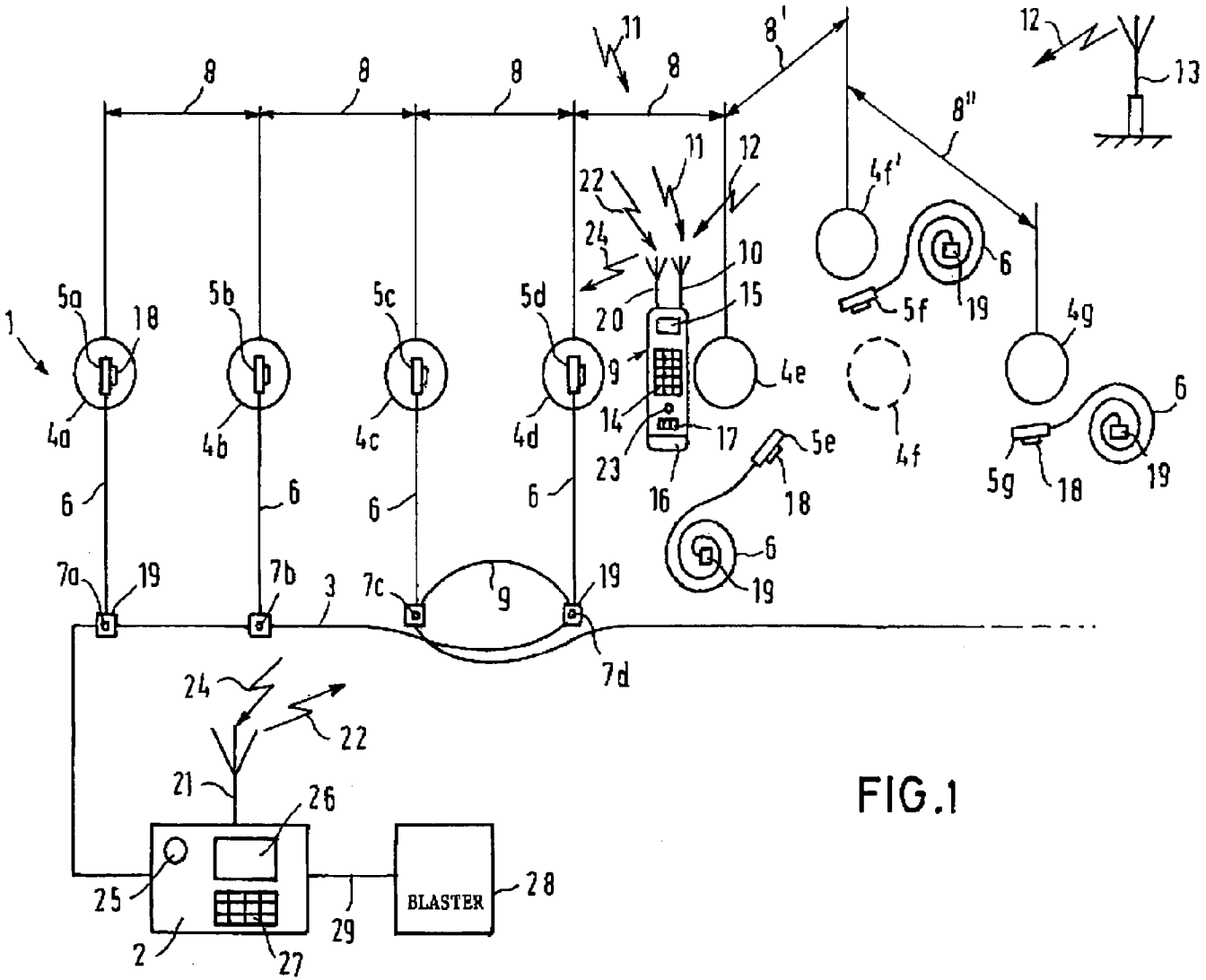

The present invention relates to a method for installing an ignition system, and the ignition system.

An ignition system consists of a data reading and storage unit, a so-called logger, to which a plurality of ignition devices (fuses) are connected via a bus line, which ignition devices are ignited in a predetermined chronological order on the basis of an ignition command from an ignition unit connected upstream of the logger or from a triggering device, a so-called blaster. The bus line may in addition to the transmission of the signal also serve to supply energy to the ignition devices, in particular to charge up the ignition capacitors. Such ignition systems are used in the opencast mining of, mineral resources, for example ores and coal, and in the rock and earth industry.

Ignition systems are known that use ignition devices that have for example an identification number allocated during the course of manufacture or that have a barcode as identification code. This identification code may also be stored in the electronics of the ignition device. By means of this identification code the ignition device can be accessed by the programming and storage electronics of the logger if its functions, for example a delay time, are to be stored.

In the installation of an ignition system the spatial position of an ignition device in terms of its surroundings, i.e. its geographical position, is not yet fixed for the specific application. In order to ensure that the ignition devices are connected to the ignition system according to a predetermined blasting plan, extreme care is required on the part of the user. For this purpose a specially trained person systematically has to carry out a sequential connection (compulsory sequence) of each ignition device to the bus line of the ignition system, i.e. logging. This procedure is described for example in WO 96/16311. The ignition devices that are connected to the ignition system initially all have the same time delay. During the coupling procedure the identification codes allocated to the ignition devices are input manually into a portable intermediate store or are electronically read out and stored by means of a data scanner. In addition the position of each ignition device in the ignition circuit as well as the delay time associated therewith are input into this intermediate store. These intermediately stored data are read from the intermediate store into the logger once all the ignition devices have been connected up.

The person connecting the ignition devices has to carry out the ignition programming in the field with extreme care under all weather conditions, which means that a blasting operation is a very time-consuming process. If an ignition device is overlooked during the logging, this results in a time-consuming reprogramming of the already input data. The object of the invention is to simplify the installation of an ignition system.

BRIEF SUMMARY OF THE INVENTION

In the installation of the described ignition systems the position of the individual ignition devices is to start with not yet known, For each blasting operation, for example when blasting boreholes, the accurate position of the borehole and thus of the ignition device is specified in a drilling plan. To this end the boreholes to be allocated for the charges are marked on the drilling plan and the distances of the boreholes from one another are recorded in the plan. According to the invention the geographical positions of the ignition devices are determined with the aid of a satellite-aided navigation system GPS (Global Positioning System), when the ignition devices are connected to the ignition system, an inductive or electrical contact with the bus line being produced. The person connecting the ignition systems carries a GPS receiver with him. When connecting an ignition device the GPS receiver is placed at the position of the borehole and the position of the ignition device is thus determined, which as a rule is the geographical position of the borehole associated with the ignition device.

GPS is based on satellites that circle the earth in so-called semi-geostationary orbits. The signals from at least four satellites can be received at any location on the earth. The GPS receiver devices measure the time that the signals take to reach the user. Since the velocity of the radiowaves as well as the positions of the four satellites are known, a microprocessor can calculate the unknown variable, the geographical position of the user, in three dimensions. The measurement accuracy is however of an order of magnitude of only about 30 m. Such an inaccuracy is of course unacceptable for the intended application.

In order to improve the accuracy additional stationary GPS receivers whose respective geographical positions are accurately known have already been used, for example in the automotive sector. The differential GPS (DGPS) is based on comparing, at a known location, the deviation of the correct co-ordinates from the data of a GPS receiver. The difference between the displayed position and the previously determined actual position is then transmitted to the user in the vicinity, who then appropriately corrects his own GPS data. Such transmitters are not available in sparsely populated regions of the world, for example Australia, Canada or Siberia, which means that the use of the GPS system consequently leads to unacceptable deviations from the actual position.

For use in exploration and in the extraction of raw materials an autonomous system is used according to the invention. A transmitter (feed transmitter for correction data) is installed in each quarry, opencast mine or exploration field and its geographical position is accurately measured. These data are used in order to correct the GPS co-ordinates. With this method it is possible to determine a position to an accuracy of 20 cm. By coupling the drilling plan data it is also conceivable additionally to increase the accuracy by for example comparing the distances of the boreholes from one another specified in the drilling plan with the co-ordinates of the boreholes determined by means of the expanded GPS system (DEGPS) and then comparing the resulting distances from one another.

If the user, i.e. the person connecting the ignition devices, is equipped in addition to the GPS receiver also with a data reading and input device plus memory and a two-way transmitter/receiver connected thereto, then advantageously not only can the position of the ignition device and thus its position in the drilling plan, i.e. its co-ordinates, be accurately determined. In addition the identification code of the ignition device that has been stored in the transmitter/receiver by manual inputting, scanning in or in another suitable way, together with the borehole data and thus ignition device data can be transmitted by radio to the logger. The data record transmitted by radio to the logger accordingly contains the geographical co-ordinates of the ignition device in the field, i.e. its location or its geographical position, and possibly its depth position in a borehole, which is stored as an ignition device address in the logger together with the identification code of the ignition device.

If the ignition devices provided for a blasting operation are freely programmable as regards their delay time, then according to the invention only the respective identification codes and the geographical co-ordinates determined by means of the GPS system are needed in order individually to prepare a blasting plan with the aid of a computer loaded with suitable software. The accurate maintenance of the sequence of ignition devices with preset delay times is no longer necessary when the devices are installed in the boreholes, since each ignition device can be identified in the blasting plan and can therefore also individually be accessed and thus also programmed. For this reason ignition devices can be reprogrammed as regards the delay time or can be withdrawn completely from an already installed ignition system without having to intervene physically. This is advantageous if, due to unforeseen circumstances, for example due to a stripping device that has been left behind, a region has to be withdrawn from the envisaged blasting operation.

By using the global positioning system expanded with a feed transmitter, it is possible according to the invention to identify accurately the geographical position of ignition devices in an ignition system anywhere in the world and thereby accurately allocate a delay time to the respective ignition device. It is therefore advantageous to combine the satellite-supported navigation system, the GPS receiver, together with the electronics for collecting and processing the ignition device data and transmitting the latter to the logger, in one unit, the ignition device data and position transmitting unit, whereby the installation of an ignition system is substantially facilitated.

The programming of the sequence of the blasting operation is carried out by a specialist after all ignition devices have been logged, i.e. have been connected. To this end the specialist can input already preprogrammed and tested blasting software into the loggers. The setting of the delay time according to the blasting programme is preferably carried out by means of prepared software, by reading data already read into the logger into a programming and test system with which the blasting operation can be simulated on a computer. For this purpose the drilling plan together with the position of the boreholes and the envisaged sequence of the ignition of the ignition devices are input into the computer. After programming and testing have been carried out and any changes have possibly been made, the final version of the envisaged programme for the blasting operation is read into the logger, the delay time envisaged for each ignition device then being associated with the respective ignition device connected to the logger, corresponding to its position and its identification code. A time-consuming manual programming in situ, which is subject to possible errors, is thus no longer necessary.

The advantage of the method according to the invention resides furthermore in the fact that the responsibility for the correct sequence of the blasting programme rests solely on a qualified blasting engineer, while the logging, the connection of the ignition devices, can be carried out by auxiliary staff.

The connection order can be monitored with the aid of the invention. If the connection of an ignition device is overlooked or if ignition devices are connected in the wrong order, this is detected after the blasting programme has been loaded into the logger since the input borehole co-ordinates and the ignition devices associated therewith do not correspond to the actual ignition device occupancy. The method according to the invention enables the identification codes of the ignition devices and the spatial location of the ignition devices in the ignition system to be recognised. It is therefore possible at any time to reprogram the delay time of the individual ignition devices in the ignition system.

More than 1600 ignition devices may be used in large scale blasting operations. In such cases several loggers have to be employed. For each of these loggers the auxiliary staff have access to the same type of ignition device data and position transmission units. In order to avoid errors during the connection of the ignition devices, such as for example allocating ignition device data to the wrong logger, with each data record of an ignition device to be transmitted by the unit, there may in addition be sent the identification code of the logger, for example the serial number, in which the data are to be stored.

The blasting data, such as for example borehole co-ordinates, ignition device identification code, delay time, etc., may be entered on a map (location plan) in which connection this map can be prepared by the computer processing the blasting programme on the basis of the available data per se. with the aid of this location plan it is clear whether one or more ignition devices having the envisaged delay time is/are associated with each borehole.

It is conceivable for several ignition devices to be used in one borehole. For example, in stope working it may be necessary depending on the stope height and thus the borehole depth to arrange ignition devices at different depths in a borehole. The ignition devices are first of all distinguished by being connected to ignition lines of different lengths. The positions can be differentiated for example by an optically visible coding, preferably a colour coding or a body coding, for example a multi-pole plug or coupler, or by flags attached to the ignition line. For the first distinguishing feature buttons with matching colours may be provided on the ignition device data and position transmitting unit, while for the further embodiment there may be provided a device, for example a socket, for coupling to the body differentiation device. Using the buttons or for example the plug, an electronic circuit is actuated that in each case generates a code which depends on the depth position of the ignition device in the borehole and is added to the ignition device address. If the corresponding button is pressed before the logging, the ignition device with the corresponding colour or body coding has to be connected. Accordingly, apart from its geographical position the ignition device is also coordinated with its depth position in the borehole.

A further possible way of identifying the different depth positions of the ignition devices is to attach flags, barcodes or magnetic strips to the code carriers, for example to the ignition lines, that are scanned by the reading head of the ignition device data and position transmitting unit.

The co-ordination of ignition devices and depth positions in the borehole may be achieved in another way, for example by a multi-pole plug, wherein a different number or a spatially different arrangement of contact pins in a plug may be provided depending on the depth position of the respective ignition device. A socket for the plug is arranged on the ignition device data and position transmitting unit. If the plug is inserted into the socket only the existing pins form a contact, which is in each case associated with a depth position. An electrical circuit is thereby closed and a code signal is generated that is associated with the connected ignition device and that characterises its position in the borehole. The plug may, such as for example in the case of the colour code of the preceding identification embodiment, be clamped to the ignition line without making an electrical contact therewith.

BRIEF DESCVRIPTION OF THE SEVCERAL VIEWS OF DRAWINGS

The method according to the invention for installing an ignition system as well as the ignition system are illustrated on the basis of embodiments and with the aid of the following diagrams, in which;

FIG. 1 shows an ignition system installed in situ

Figure 2:
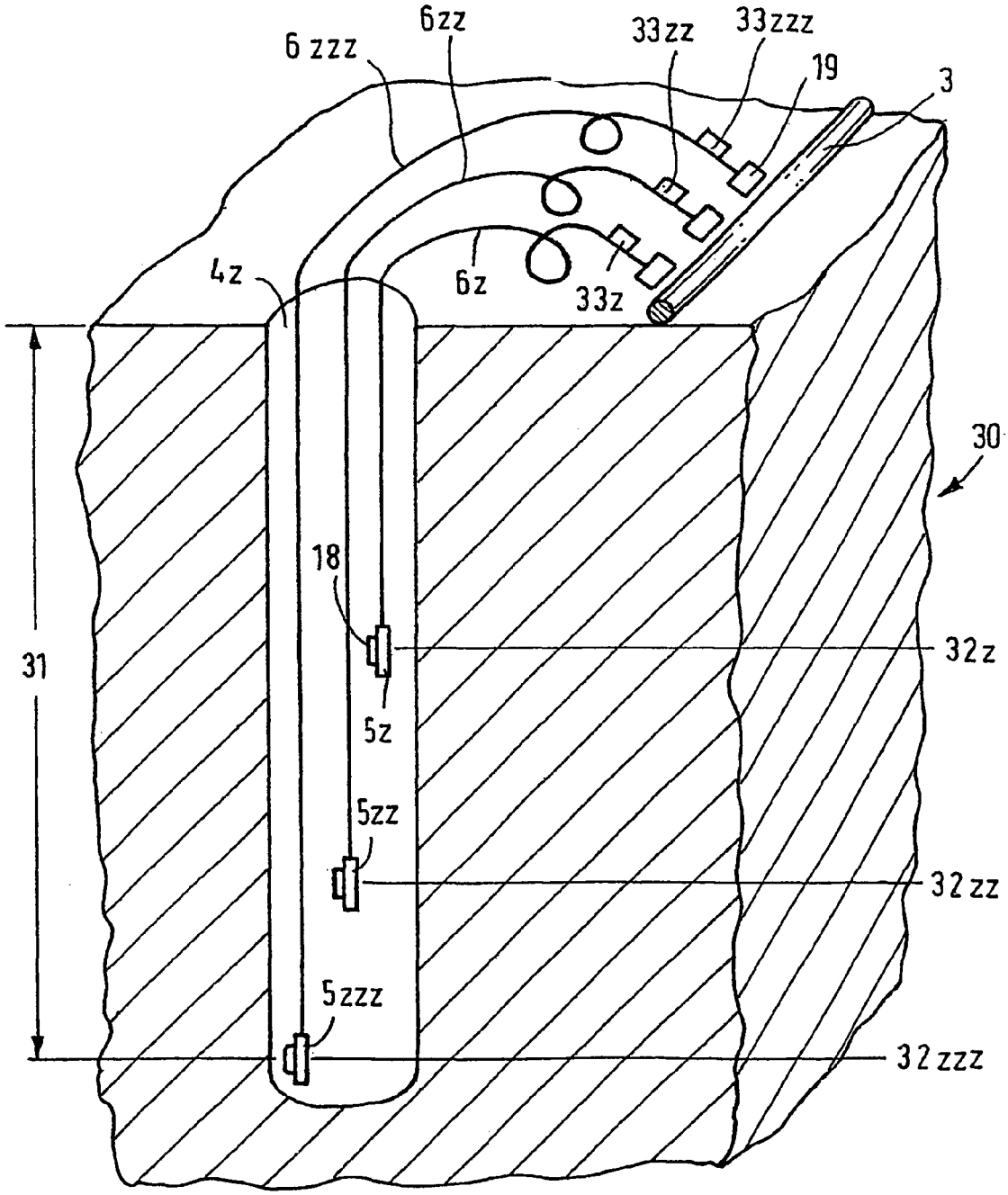
Figure 3:
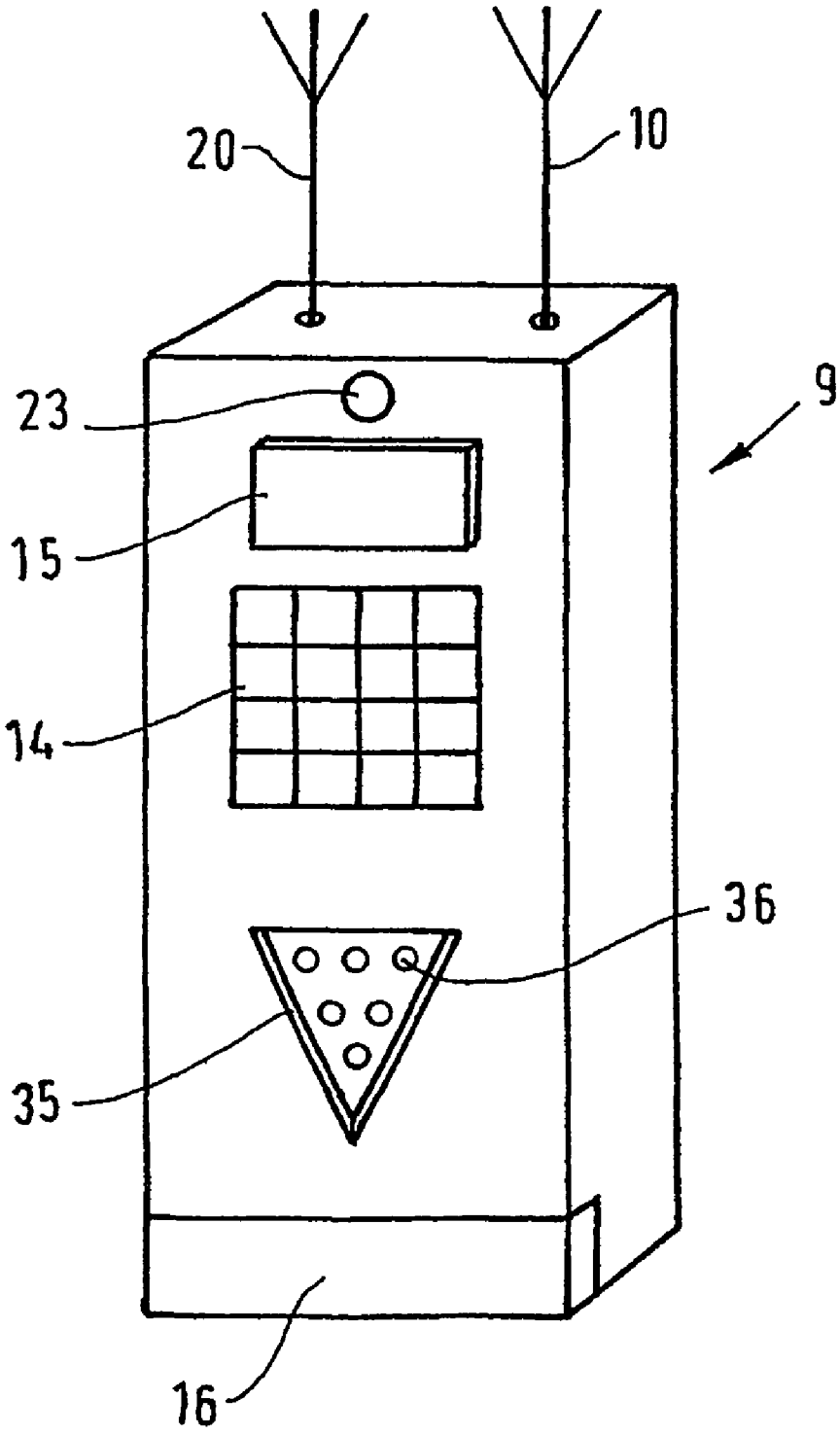
Figure 4A:
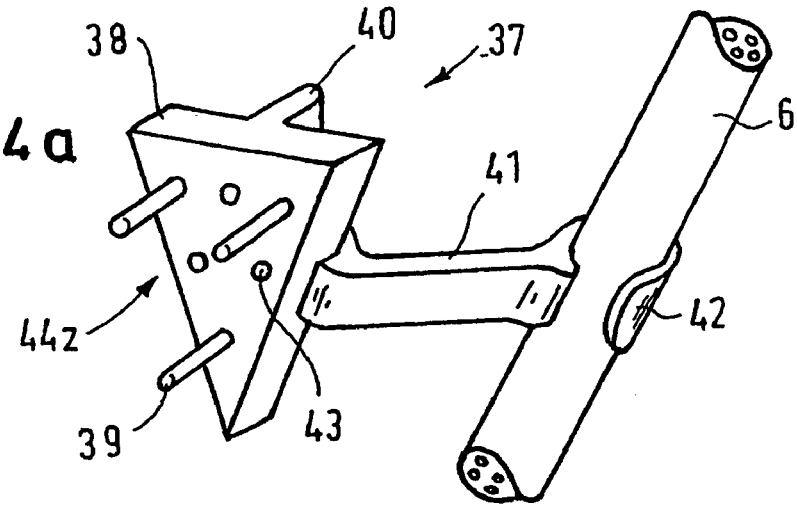
Figure 4B:
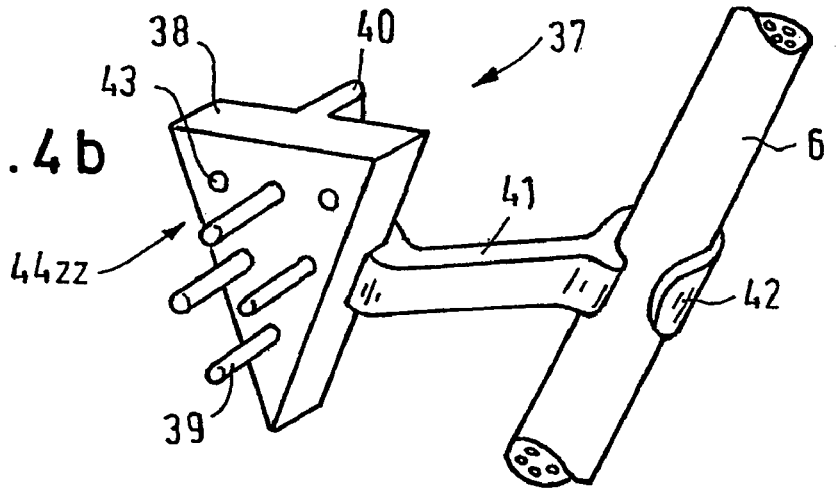
Figure 4C:
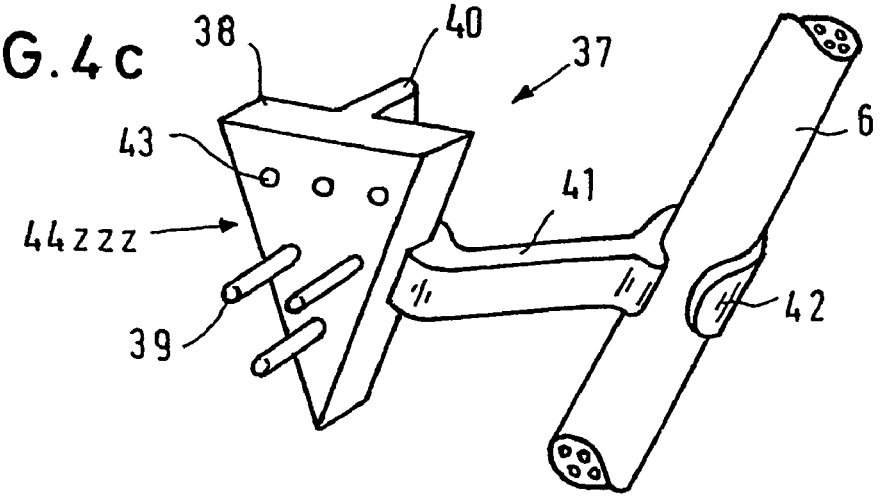

FIG. 2 shows a borehole with three ignition devices at different depth positions FIG. 3 is a diagrammatic representation of an ignition device data and position transmitting unit with a socket device for inputting the depth position of an ignition device, and FIGS. 4*a*–4*c* are embodiments of a plug with contact pins that are provided for insertion into the socket device of the unit according to FIG. 3, and wherein the contact pins are arranged depending on the associated depth position of the ignition device in each case.

DETAILED DESCRIPTION OF THE INVENTION

FIG. 1 shows an ignition system according to the invention, identified overall by the reference numeral 1. A bus line 3 has been laid from a data reading and storage unit, i.e. a logger 2, along the boreholes 4*a* to 4*g*. The arrangement illustrated in FIG. 1 may be regarded as a section of an ignition system having a substantially larger number of boreholes. An ignition device 5*a* to 5*g* is associated with each of the illustrated boreholes 4*a* to 4*g*. An ignition line 6 is already connected to the ignition devices 5*a* to 5*g*; the line 6 is in turn connected to the bus line 3 once connection has already been made to the connection points 7*a* to 7*d*, for example inductively or by electrical contact.

The boreholes 4*a* and 4*g* should be at a specified distance 8 from one another, which is entered on a drilling plan. The distance 8 of the boreholes from one another is thus known. As a rule the distance 8 of the boreholes from one another is constant if for example there are a large number of boreholes within a stope working. A loop 9 has been formed between the boreholes 4*c* and 4*d* due to careless laying of the bus line 3. As a result the ignition devices 5*c* and 5*d* have been wrongly connected as regards their order to the bus line 3. With the connection point 7*d* the borehole 4*d* is in front of the borehole 4*c* in the order of the connected boreholes. How this error is detected is explained in more detail below.

The connection of the prepared ignition device 5*e*, which is already connected to the ignition line 6*e*, to the bus line 3 and thus to the logger 2 is described in more detail with the aid of the borehole 4*e*. The person connecting the ignition devices carries an ignition device data and position transmitting device 9. In order to determine accurately the geographical position of the borehole 4*e* and thus its allocation on the drilling plan, this device 9 is positioned directly next to the borehole 4*e*. An even more accurate position location is achieved if the device is held directly over the borehole. The device 9 is shown here only diagrammatically. An essential component of the device 9 is a DGPS system, the receiving antenna 10 of which is illustrated. This antenna receives the signals 11 from the GPS satellites and the signal 12 from the transmitter 13, which provides a geographically accurate measurement and is located for example in an opencast working. With the aid of the received signals 11 and 12 the geographical position of the borehole 4*e* is determined to an accuracy of about 20 cm. In addition the device 9 contains an alphanumeric keyboard 14 for inputting data, a display 15 for displaying data, and a reading head 16, for example a scanner, for reading in a barcode. An additional facility is advantageous if the depth position of several ignition devices in one and the same borehole has to be entered. This may be accomplished for example via a keyboard 17 with different coloured keys, a specific colour being associated with each depth position, or via a plug-socket combination, the number or the arrangement of the poles of a multi-pole plug being fixed in relation to a respective depth position.

When the position of the borehole 4*e* has been accurately determined, the identification code 18 of the ignition device 5*e* is read in. This identification code 18 may for example be in the form of a barcode on the ignition device 5*e*. It can then be read in using the reading head 16 designed as a scanner.

After the identification code 18 of the ignition device 5*e* has been read in, this ignition device can be associated with the borehole 4*e*. The ignition device 5*e* is then connected to the bus line 3 by means of a coupler 19 secured to the end of the ignition line 6, and is let into the borehole 4*e*. The connection may be effected electrically-mechanically or inductively, so that a two-way data transfer between the ignition device 5*e* and the logger 2 is possible. During the determination of the position of the borehole 4*e* and thus of the ignition device 5*e* and the reading in of the identification code 18 of the ignition device 5*e*, the logger 2 and the device 9 are in a state of transmission and reception readiness. To this end the device 9 has a further transmission and receiving antenna 20 for two-way data exchange with the logger 2, which in turn likewise has a transmission and receiving antenna 21.

When the ignition device 5*e* is connected via its coupler 19 to the bus line 3, this is recorded by the logger 2 and a signal 22 is sent to the device 9 to confirm the connection. The device 9 can acknowledge the receipt of this signal 22, for example on the display 15 or by an optical or acoustical signal transmitter 23 on the device 9. The logger 2 registers the connected ignition device 5*e* first of all only in the order of the connection, i.e. as the fifth connected ignition device. After receiving the signal 22 from the logger 2 the device 9 transmits the identification code of the ignition device 5*e* and its exact geographical position, i.e. the position of the borehole 4*e*, to the logger 2, as is indicated by the symbol 24. The logger 2 allocates the order of the connection and the position of the borehole 4*e* to the ignition device 5*e*, which thus contains an address corresponding to the blasting plan.

If the identification code is stored in the electronics of the ignition device, the latter can notify its code itself to the logger already during the connection to the bus line.

The setting of the delay time corresponding to the envisaged blasting programme takes place preferably with the aid of prepared software in a computer, by reading the data stored in the logger into a programming and test system, which can carry out a simulation of the blasting operation. To this end the drilling plan, including the location of the boreholes, the location of the ignition devices and the envisaged order of ignition of the ignition devices, i.e. the blasting plan, are input into the computer. After programming, testing and possible alterations have been carried out, the final version of the programme envisaged for the blasting operation is read into the logger, each ignition device then being allocated its envisaged delay time corresponding to its position and its identification code. In order to read the data into the computer and the programme into the logger, the logger can be detached from the bus line of the ignition system and connected to the computer.

Each ignition device is uniquely recorded in the blasting plan by means of its identification code and its geographical position and can thus be individually programmed at any time, i.e. a freely selectable delay time can be stored in it at any time or it can even be completely withdrawn from the blasting plan without having to intervene physically.

Particularly when using several loggers, once all the data stored in the loggers has been checked in the programming and test system and have been used to prepare the blasting programme, the loggers may be reconnected to the bus line of the ignition system. After connecting an ignition unit, i.e. the blaster 28, by means of a bus line 29 to the logger or loggers 2, the ignition can be initiated.

The programme on which the blasting plan is based may however already have been loaded into the logger before the connection of the ignition devices.

The accuracy of the geographical data of the boreholes 4*a* to 4*g* can be improved still further if, in addition to the DGPS data, the distances 8 between the individual boreholes 4*a* to 4*g* are taken into account. The distance of the boreholes from one another is specified in a drilling plan for the respective blasting operation. In this way it is possible to compare the distance between two adjacent boreholes, as specified in the drilling plan, with the value that can be calculated by measuring the distance between the respective geographical positions of the boreholes. If the distances determined by means of DGPS data differ unallowably from the distances according to the drilling plan, a correction of the geographical position can be carried out.

When laying out the bus line 3 a loop 9 was formed between the boreholes 4*c* and 4*d*, as a result of which the ignition devices 5*c* and 5*d* were wrongly connected as regards their order. The blasting program detects this error when the delay times allocated to the ignition devices 5*c* and 5*d* are to be transmitted from the logger 2. It then turns out in fact that the ignition devices 5*c* and 5*d*, as regards the order in which they have been connected, in each case geographically do not adopt the position that had been envisaged for them according to the drilling plan and the blasting plan. The distance between the ignition devices 5*b* and 5*c* is twice as large as it ought to be according to the drilling plan. The distance between the ignition devices 5*b* and 5*d* on the other hand is only of length 8, so that here too the allocation of the order does not agree with the geographical position. The wrong connection as regards the order is recognised by the lack of agreement with the position data specified in the drilling plan. The program according to which the ignition devices are allocated their delay time can consequently be stopped and a signal can be triggered at the logger, which may be notified optically or acoustically by a signal transmitter 25. The type of error can be visualised on a display 26. The error can be rectified by inputting the corresponding correct data by means of an alphanumeric keyboard 27.

The method according to the invention also enables wrongly positioned boreholes to be recognised when the ignition system is installed. The borehole 41*f'* shown in FIG. 1 is not located at the site intended in the borehole plan, which is marked by the dotted borehole 4*f*. Due to the fact that the position of the borehole 4*f'* does not agree with the borehole plan, the geographical position and thus the distance to the preceding borehole 4*e* is changed from the preset distance 8 to the distance 8', and to the following borehole 4*g* to the distance 8". On comparing the data of the borehole plan entered in the logger 2 with the actual data that have been determined by the device 9, the position error of the borehole 4*f'* is recognised by the fact that the distances 8' and 8" resulting from the difference of the co-ordinates of the geographical position data of the respective boreholes determined by means of DGPS, do not agree with the distance 8 specified on the borehole plan. This is recognised position error of the borehole 4*f'* can be shown on the display 26 of the logger 2 and notified via the signal transmitter 25.

A section 30 of a terrain profile including a borehole 4*z* is illustrated in FIG. 2. The borehole 4*z* is sliced longitudinally. Three ignition devices 5*z*, 5*zz* and 5*zzz* are arranged in descending order over the depth 31 of the borehole 4*z*. The ignition device 5*z* adopts the depth position 32*z*, the ignition device 5*zz* the depth position 32*zz* and the ignition device 5*zzz* the depth position 32*zzz*. The associated ignition line is also variously long corresponding to the respective depth positions. The ignition line 6*z* of the ignition device 5*z* is the shortest, followed in increasing length by the ignition line 6*zz* of the ignition device 5*zz* and the ignition line 6*zzz* of the ignition device 5*zzz*.

Before the ignition lines are connected to the respective coupler 19 at the bus line 3 that runs past, the corresponding depth positions have to be allocated to the ignition devices and entered into the device 9. The depth positions may be identified for example by coloured flags 33*z*, 33*zz* and 33*zzz* on the respective ignition lines 6*z*, 6*zz* and 6*zzz*. In this connection each flag is of a different colour so that the ignition device connected in each case to the ignition line can already be allocated to its respective depth position on the basis of the colour coding. Although not shown here, input keys of the same colour as the colours on the flags that are associated with specific depth positions are arranged on the device 9. Before connecting a coupler 19 to the bus line 3 the coloured key on the device 9 whose colour corresponds to the colour of the flag on the bus line of the corresponding ignition device must first of all be depressed. The correct depth position is thereby allocated to the respective ignition device.

Instead of a colour coding, the attached flags may also contain for example a barcode or a magnetic code, which can then be read by the reading head 16 on the device 9 and allocated to the respective borehole position. On the basis of the depth position allocated to the respective ignition device, the corresponding time delay can be allocated to the said ignition device.

FIGS. 3 and 4*a* to 4*c* show an embodiment associated with FIG. 2 for detecting the different depth positions of the ignition device. The ignition device data and position transmitting unit 9 is shown diagrammatically in FIG. 3. In addition to the features enumerated in the description relating to FIG. 1 and instead of the keyboard 17, the device 9 has a socket 35. In the present embodiment this is in the shape of an isosceles triangle. Since on account of this shape a plug can be inserted only in one position, the allocation of the contact pins of the plug to the holes 36 of the socket 35 is unique.

In the present embodiment an array of six holes 36 is arranged on the socket 35, into which the contact pins of the plugs can be inserted, as illustrated in FIGS. 4*a* to 4*c*.

FIGS. 4*a* to 4*c* show three embodiments of a characterising device in the form of a plug 37, by means of which the different depth positions of the ignition devices in a borehole can be characterised. The plugs 37 may be produced for example in one part from plastics material. The triangular part 38 carries the contact pins 39 and has on its reverse side a handle 40, which facilitates the insertion into and the removal from the socket 35 on the device 9. A clip 42 is arranged on a flag 41 on the actual plug part 38. By means of this clip 42 the characterising device 37 can be removably clipped onto the ignition lines 6 of the ignition devices, as shown in FIGS. 4*a* to 4*c*.

As can be seen from FIGS. 4*a* to 4*c*, the array of the contact pins coincides with the array of the holes. 36 in the socket 35. Of course, not all spaces 43 provided for this purpose on the part 38 are occupied by contact pins. The occupancy by contact pins 39 corresponds in the three embodiments of FIGS. 4*a* to 4*c* to an array 44*z*, 44*zz* and 44*zzz*, which in each case is associated with a specific depth position 32*z*, 32*zz* and 32*zzz* of an ignition device 5*z*, 5*zz* and 5*zzz*. Accordingly, the plug 37 having the occupancy array 44*z*, in which three contact pins 39 are arranged in the form of a triangle, should be associated with a depth position 32*z*. The occupancy array 44*zz* in FIG. 4*b* should be associated with the depth position 32*zz*, and the occupancy array 44*zzz* should be associated with the depth position 32*zzz*.

The contact pins 39 can form electrical contacts when the plug 37 is inserted into the socket 35. For this purpose it is advantageous if the contact pins 39 are of metal. The contact pins 39 may however also separate contacts. This is advantageous if the contact pins, like the parts of the plug 37, are made of plastics. In this case the plug can be produced in one part as a plastics moulding, which is very inexpensive.

The closing or opening of the contacts when the plug 37 is inserted into the socket 35 triggers, depending on the occupancy array, a sequence of signals that is associated with a specific depth position.

Instead of an occupancy array, a predetermined number of contact pins may also be associated with a specific depth position. Furthermore it is possible to produce the plugs from coloured plastics material, a specific colour being associated in each case with a specific depth position. This facilitates the identification of the plugs, since the occupancy array or the number of contact pins does not have to be checked first of all.

The invention claimed is:

1. A method for the installation of an ignition system comprising a logger, the logger comprising a data reading and storage unit, by means of which a plurality of ignition devices can be ignited in a predeterminable chronological order, the method comprising connecting the ignition devices to a signal transmission and energy supply line in the form of a bus line, identifying the ignition devices by reading an individual code for each of the ignition devices into the logger, wherein the signal for the ignition is given by an ignition unit, the blaster, connected upstream of the logger, determining the geographical position of one of the ignition devices by means of a satellite-aided navigation system (GPS), transmitting the position of the one ignition device to the logger, additionally allocating the position of the one ignition device in the order of connection of the ignition devices to the logger to an address of one ignition device, and storing the position in the order of connection with the address.

2. Method according to claim 1, wherein a distance between two adjacent ignition devices fixed according to a specified plan is compared to a difference of the coordinates of the geographical data determined for the two adjacent ignition devices.

3. Method according to claim 2, wherein any error involved in the order of connection of ignition devices is determined at the logger by comparing the difference of the coordinates of the geographical data of two adjacent ignition devices with the distance of the two adjacent ignition devices from one another as specified in the plan, as well as by comparing the order of the connection of the two adjacent ignition devices.

4. Method according to claim 2, wherein the geographical deviation of the position of one of the ignition devices from its intended position is determined at the logger by comparing the difference of the coordinates of the geographical data of two adjacent ignition devices with the distance of the two adjacent ignition devices from one another as specified in the plan, as well as by comparing the order of the connection of the two adjacent ignition devices.

5. Method according to claim 1, wherein the accuracy of the position data of the one ignition device is increased with the aid of a so-called differential global positioning system (DGPS), wherein the signal of an additional stationary terrestrial transmitter is utilized in the satellite-aided navigation system (GPS), from which the geographical data of the location of the stationary terrestrial transmitter are accurately known.

6. Method according to claim 1, wherein in the case of a multiple occupancy of a geographical position with a plurality of ignition devices at different depth positions, the plurality of ignition devices are characterized with characterizing means according to their depth position, by means of which a code associated with the depth position is generated, which code together with the identification code of each of the plurality of ignition devices is transmitted to the logger and associated with each of the plurality of ignition devices.

7. Process according to claim 1, wherein a delay time that is necessary for the intended use of the one ignition device can be individually allocated to each ignition device on the basis of its known geographical position and its known identification code.

8. Method according to claim 1, wherein, where several loggers are simultaneously used, an identification code is associated with each logger and the identification code of the logger in which the data are to be stored is additionally transmitted with a transmitted data record of one of the ignition devices.

9. Method according to claim 1, wherein the data stored in the logger are read into a programming and test system in order to simulate the envisaged blasting operation on a computer.

10. Method according to claim 9, wherein a program envisaged for the blasting operation is prepared by means of the programming and test system on the basis of a plan for the arrangement of the ignition devices and the envisaged order of ignition of the said ignition devices, and is input into the logger.

11. Method according to claim 10, wherein by means of the program prepared for the blasting operation, a delay time envisaged for each of the ignition devices is allocated by means of the said program to each ignition device connected to the logger, corresponding to its geographical position and its identification code.

* * * * *